US011559991B2

(12) United States Patent
Profaca

(10) Patent No.: US 11,559,991 B2
(45) **Date of Patent: *Jan. 24, 2023**

(54) METHOD OF CAPPING PRINTHEADS ARRANGED ALONG CURVED MEDIA PATH

(71) Applicant: Memjet Technology Limited, Dublin (IE)

(72) Inventor: Mark Profaca, North Ryde (AU)

(73) Assignee: Memjet Technology Limited

( * ) Notice: Subject to any disclaimer, the term of this patent is extended or adjusted under 35 U.S.C. 154(b) by 0 days.

This patent is subject to a terminal disclaimer.

(21) Appl. No.: 17/138,645

(22) Filed: Dec. 30, 2020

(65) Prior Publication Data

US 2021/0114376 A1 Apr. 22, 2021

Related U.S. Application Data

(63) Continuation of application No. 16/175,627, filed on Oct. 30, 2018, now Pat. No. 10,906,317.

(60) Provisional application No. 62/579,735, filed on Oct. 31, 2017.

(51) Int. Cl.

| | |
|---|---|
| ***B41J 2/165*** | (2006.01) |
| ***B41J 2/145*** | (2006.01) |
| ***B41J 25/34*** | (2006.01) |
| ***B41J 25/304*** | (2006.01) |
| ***B41J 2/155*** | (2006.01) |

(52) U.S. Cl.

CPC ..... *B41J 2/16505* (2013.01); *B41J 2/145* (2013.01); *B41J 2/155* (2013.01); *B41J 2/16511* (2013.01); *B41J 2/16535* (2013.01); *B41J 2/16547* (2013.01); *B41J 2/16585* (2013.01); *B41J 25/304* (2013.01); *B41J 25/34* (2013.01); *B41J 2202/20* (2013.01)

(58) Field of Classification Search

CPC ..... B41J 2/165; B41J 2/145; B41J 2/16511; B41J 2/16547; B41J 2/16505

See application file for complete search history.

(56) References Cited

U.S. PATENT DOCUMENTS

| | | | | |
|---|---|---|---|---|
| 6,578,945 | B2 * | 6/2003 | Hashi | B41J 11/0095 347/22 |
| 8,038,258 | B2 * | 10/2011 | Ray | B41J 2/16547 347/37 |
| 8,109,600 | B2 * | 2/2012 | Okada | B41J 2/16511 347/29 |

* cited by examiner

*Primary Examiner* — Lam S Nguyen
(74) *Attorney, Agent, or Firm* — Cooley LLP

(57) ABSTRACT

A method of capping printheads positioned along a curved media path having an apex. The method includes the steps of: providing a first printhead upstream of the apex and a corresponding first capper downstream of the first printhead; providing a second printhead downstream of the apex and a corresponding second capper upstream of the second printhead; moving the first capper towards the first printhead and capping the first printhead; and moving the second capper towards the second printhead and capping the second printhead. The first and second cappers are moved in opposite directions away from the apex for capping the first and second printheads.

6 Claims, 7 Drawing Sheets

METHOD OF CAPPING PRINTHEADS ARRANGED ALONG CURVED MEDIA PATH

CROSS-REFERENCE TO RELATED APPLICATIONS

This application is a Continuation of U.S. application Ser. No. 16/175,627 filed Oct. 30, 2018, which claims the benefit of priority of U.S. Provisional Application No. 62/579,735 filed Oct. 31, 2017, the contents of which are incorporated herein by reference in their entirety.

FIELD OF THE INVENTION

This invention relates to a print engine for an inkjet digital press. It has been developed primarily for integrating an array of print modules into a low-cost color inkjet press suitable for short-run print jobs.

BACKGROUND OF THE INVENTION

Inkjet printers employing Memjet® technology are commercially available for a number of different printing formats, including desktop printers, digital inkjet presses and wideformat printers. Memjet® printers typically comprise one or more stationary inkjet printhead cartridges, which are user-replaceable. For example, a desktop label printer comprises a single user-replaceable multi-colored printhead cartridge, a high-speed label printer comprises a plurality of user-replaceable monochrome printhead cartridges aligned along a media feed direction, and a wideformat printer comprises a plurality of user-replaceable printhead cartridges in a staggered overlapping arrangement so as to span across a wideformat pagewidth.

U.S. application Ser. No. 15/582,998 filed 1 May 2017, the contents of which are incorporated herein by reference, describes a commercial pagewide printing system comprising an N×M two-dimensional array of print modules. Providing OEM customers with the flexibility to select the dimensions and number of printheads in an N×M array in a modular, cost-effective kit form enables access to a wider range of commercial digital printing markets that are traditionally served by offset printing systems.

Typically, web-based printers print onto print media fed over a convexly curved media path. By imparting a convex curvature to the media path, the web can be readily tensioned over a set of radially positioned rollers. With a curved media path, each printhead must also be arranged radially about the rollers. Moreover, in order to perform printhead maintenance, the printheads should ideally be lifted radially with respect to the curved media path. This ensures that a distance between the printheads and maintenance components (e.g. cappers and wipers) is consistent for all printheads in the printer. U.S. application Ser. No. 15/582,998 describes one means by which printheads may be lifted radially with respect to a curved media path: each printhead is mounted on a respective print bar having a dedicated lift mechanism mounted on a maintenance chassis.

However, it is convenient to lift radially-arranged printheads in a print engine simultaneously using a common lift mechanism without requiring each printhead (or print bar) to have its own dedicated lift mechanism. U.S. Provisional Application 62/563,584 filed 26 Sep. 2017, the contents of which are incorporated herein by reference, describes a print engine having a common lift mechanism for an array of four printheads radially arranged around a curved media path. The lift mechanism described in U.S. Provisional Application 62/563,584 employs a scissor lift mechanism in combination with a print module mounting arrangement that provides radial movement of each print module. Nevertheless, this print module mounting arrangement adds complexity to the print engine design.

It would be desirable to provide a print engine which allows radially-arranged printheads to be maintained using a common lift mechanism. It would be further desirable to avoid complex print module mounting arrangements in the print engine.

SUMMARY OF THE INVENTION

In a first aspect, there is provided a printer comprising:

a convexly curved media path for feeding print media along a media feed direction, the curved media path having an apex, a first section upstream of the apex and a second section downstream of the apex;

a plurality of printheads radially arranged with respect to the curved media path, the plurality of printheads including a first printhead positioned for printing onto the first section and a second printhead positioned for printing onto the second section;

a plurality of cappers for capping the plurality of printheads, each capper being positioned at one longitudinal side of a respective printhead and each capper being laterally moveable between capped and uncapped positions, a lift mechanism for lifting and lowering the printheads between a maintenance position and a printing position, wherein a first capper is positioned downstream of the first printhead and a second capper is positioned upstream of the second printhead in respective uncapped positions.

Preferably, the plurality of printheads are mounted on a print chassis.

Preferably, the print chassis comprises a plurality of print modules mounted thereon, each print module comprising a respective one of the printheads Preferably, the plurality of cappers are mounted on a maintenance chassis fixedly mounted relative to the curved media path, and wherein the lift mechanism moves the print chassis relative to the maintenance chassis.

Preferably, the lift mechanism vertically translates the print chassis and the printheads relative to the maintenance chassis.

Preferably, the maintenance chassis comprises a plurality of maintenance modules for maintaining the plurality of printheads, the maintenance modules being radially arranged with respect to the curved media path.

Preferably, each maintenance module comprises a respective one of the cappers.

Preferably, each maintenance module comprises an extension mechanism for laterally extending and retracting the capper between the capped and uncapped positions, respectively.

Preferably, each maintenance module further comprises a wiper carriage for longitudinally wiping a respective printhead.

Preferably, each maintenance module comprises an L-shaped frame having a longer leg housing the capper and a shorter leg housing the wiper carriage.

Preferably, a second maintenance module having the second capper is rotated by 180 degrees relative to a first maintenance module having the first capper.

Preferably, each printhead extends and retracts through a space defined by a respective maintenance module in the printing and maintenance positions, respectively.

In some embodiments, the printer further comprises a support chassis having a plurality of rollers defining the curved media path, wherein the maintenance chassis is fixedly mounted on the support chassis.

In a second aspect, there is provided a print engine comprising:

a support chassis having a plurality of rollers defining a convexly curved media path for feeding print media along a media feed direction, the curved media path having an apex, a first section upstream of the apex and a second section downstream of the apex;

a plurality of maintenance modules fixedly mounted relative to the support chassis;

a print chassis positioned over the support chassis, the print chassis comprising a plurality of print modules radially arranged with respect to the curved media path, the plurality of print modules including a first print module having a first printhead positioned for printing onto the first section and a second print module having a second printhead positioned for printing onto the second section;

a lift mechanism for linearly lifting and lowering the maintenance chassis relative to the support chassis between a maintenance position and a printing position, wherein:

each maintenance module comprises a capper for capping a respective printhead, each capper being positioned at one longitudinal side of the respective printhead and each capper being laterally moveable between capped and uncapped positions;

a first capper is positioned downstream of the first printhead in its uncapped position; and a second capper is positioned upstream of the second printhead in its uncapped position.

Preferred aspects relating to the first aspect are, of course, equally applicable to the second aspect.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "mounted" includes both direct mounting and indirect mounting via an intervening part.

BRIEF DESCRIPTION OF THE DRAWINGS

Embodiments of the present invention will now be described by way of example only with reference to the accompanying drawings, in which.

DETAILED DESCRIPTION OF THE INVENTION

Print Engine

Figure 1:
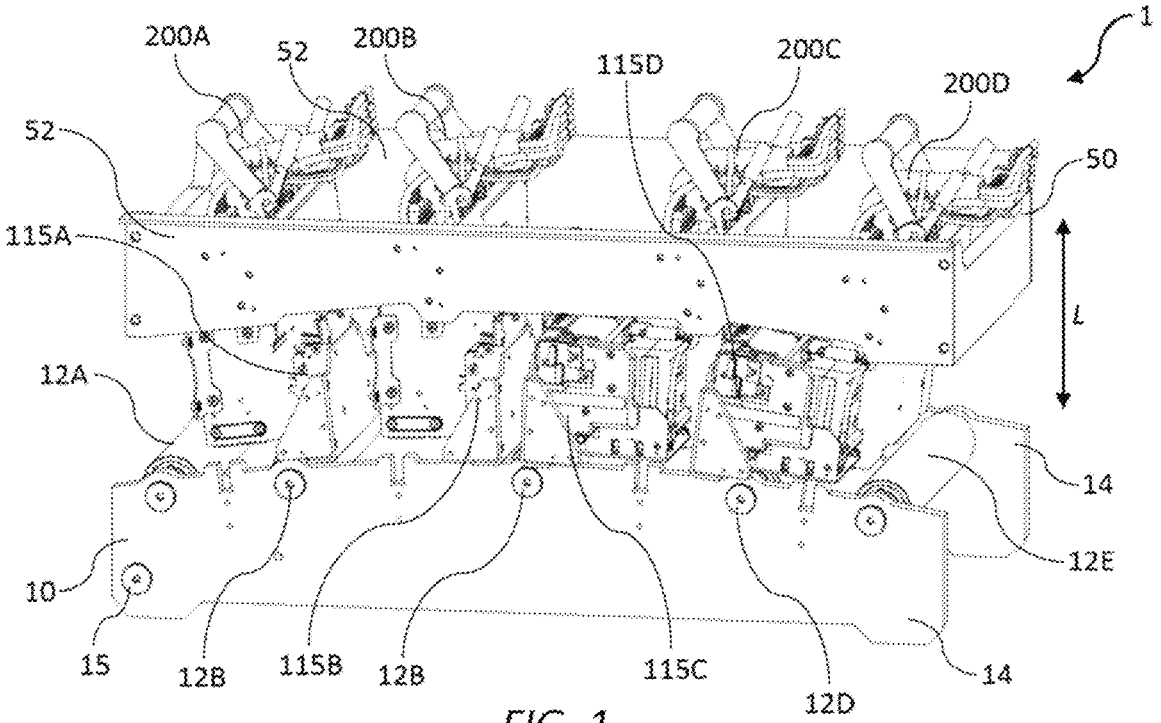
FIG. 1 is perspective view of a print engine in a printing position.
Figure 2:
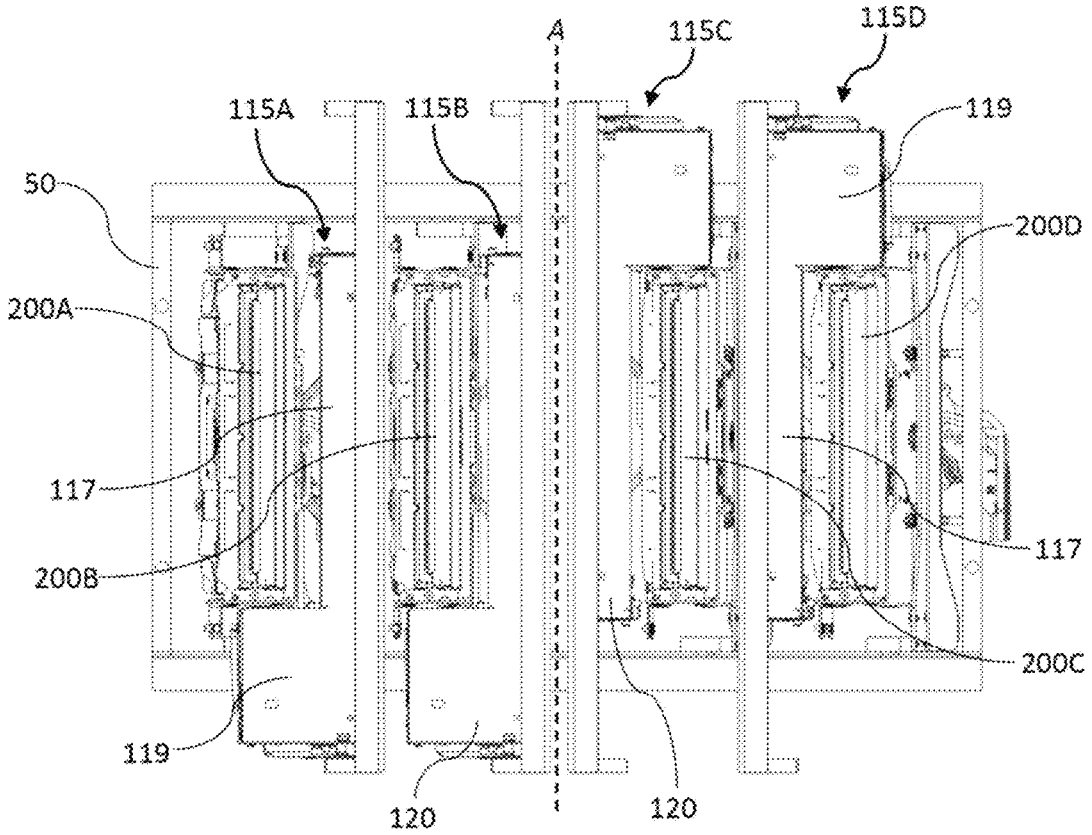
FIG. 2 is a bottom view of the print engine shown in FIG. 1.
Figure 3:
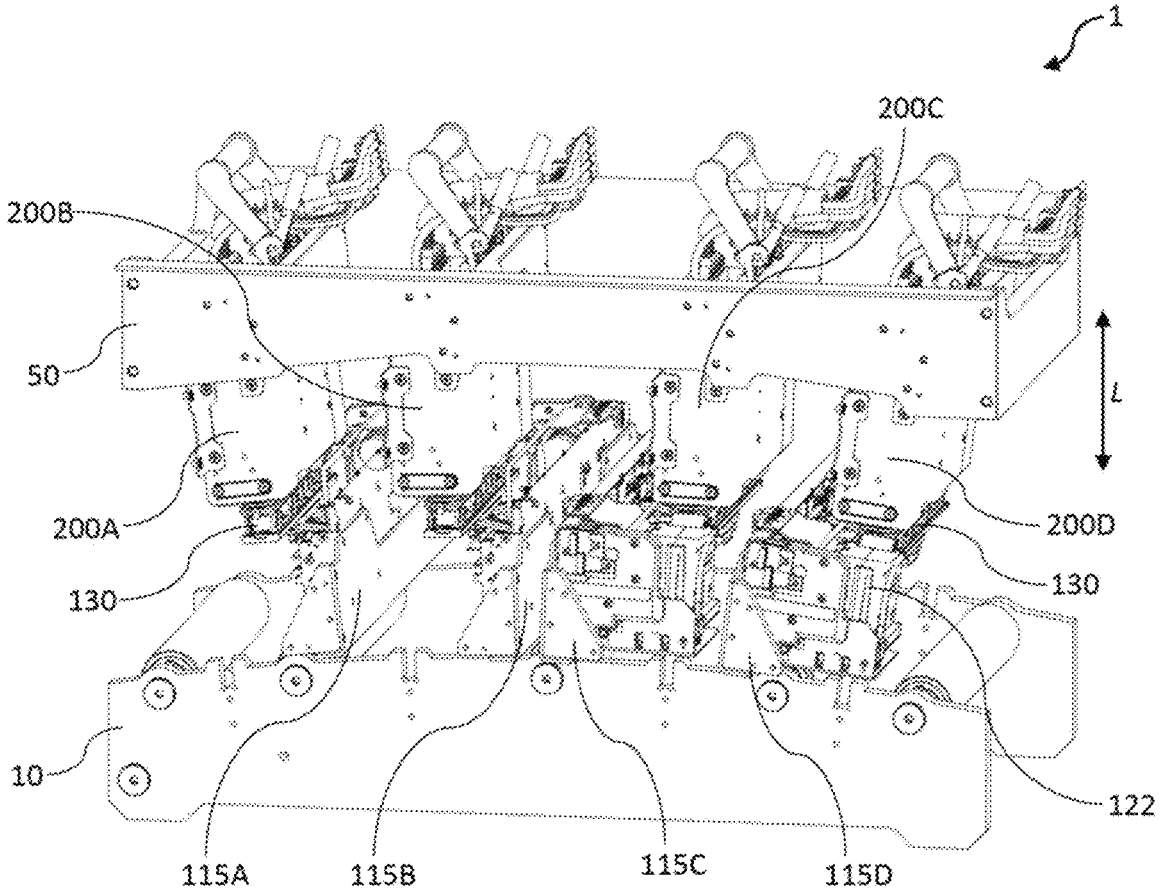
FIG. 3 is a perspective view of the print engine shown in FIG. 1 in a maintenance position.

Referring to FIGS. 1 to 3, there is shown a print engine 1 for full-color printing onto a media web. The print engine 1 is designed for OEM-customization into printers, such as digital inkjet presses meeting individual customers' requirements. The print engine 1 comprises a media support chassis 10 having a set of five guide rollers 12A-E (generically "guide rollers 12") rotatably mounted between opposite support chassis side plates 14. The guide rollers 12 are arranged so as to define a curved (convex) media feed path, which is optimal for tensioning the media web over the guide rollers. A media feed mechanism, such as those typically used in conventional offset presses (not shown), may be used for feeding the media web towards an input roller 15 positioned below the guide rollers 12 and then away from the print engine 1 under suitable tension.

The central guide roller 12C is proximal an apex (denoted by dashed line A in FIG. 2) of the media feed path, while two upstream guide rollers 12A and 12B are positioned in a first section of the media feed path at one (upstream) side of the apex and two downstream guide rollers 12D and 12E are positioned in a second section of the media path at an opposite (downstream) side of the apex.

A set of four maintenance modules 115A-D (generically "maintenance modules 115") are fixedly mounted relative to the media support chassis 10 (e.g. fixedly mounted via a maintenance chassis as described in U.S. Provisional Application No. 62/563,584, the contents of which are herein incorporated by reference). In addition, a print chassis 50 is movably mounted relative to the media support chassis 10 and supports four print modules 200A-D (generically "print modules 200"), which are fixedly mounted between opposite print chassis side plates 52 and aligned along a length of the print engine 1.

The print chassis 50 is movable along a vertical translation axis relative to the media support chassis 10 by means of a lift mechanism (schematically denoted by double-headed arrow L in FIGS. 1 and 3). The skilled person will appreciate that any suitable lift mechanism may be employed to provide the relative translational movement. For example, a scissor mechanism or a piston-extension mechanism interconnecting the print chassis 50 and the support chassis 10 are both suitable.

Two first print modules 200A and 200B are positioned for printing onto the first section of the media feed path (upstream of the apex) and two second print modules 200C and 200D are positioned for printing onto the second section of the media feed path (downstream of the apex). As shown in FIG. 1, a plurality of (four) monochrome print modules 200 are stacked along the media feed path to provide a scalable pagewide array for each of four colors (cyan, magenta, yellow and black). However, it will be appreciated that a fewer or greater number of print modules 200 may be employed in the print engine 1 (e.g. an additional spot color inkjet module). Furthermore, the print engine 1 may employ alternative stacking arrangements of the print modules 200 (e.g. staggered and overlapping across a wider media feed path).

Each print module 200 has a corresponding maintenance module 115 for maintaining a respective printhead 216 of the print module. Each maintenance module 115 has a generally L-shaped frame 120 comprising a longer leg 117 extending longitudinally along one side of a respective print module 200 and a shorter leg 119 extending transversely from the longer leg so as to be positioned at one end of the print module. The longer leg 117 of the maintenance module 115 houses a capper 130, which is laterally extendible towards and away from the print module 200, while the shorter leg 119 houses a wiper carriage 122 which is movable longitudinally along the print module for wiping the printhead 216. Capping and wiping operations of the maintenance module 115 will be described in further detail below in connection with FIGS. 6 and 7.

As best seen in FIG. 2, two first maintenance modules 115A and 115B have their longer legs 117 (housing respective cappers 130) positioned relatively downstream of their corresponding first print modules 200A and 200B; and two second maintenance modules 115C and 115D have their longer legs 117 (housing respective cappers 130) positioned relatively upstream of their corresponding first print modules 200C and 200D. Furthermore, the second maintenance modules 115C and 115D are rotated by 180 degrees relative to the first maintenance modules 115A and 115B in order to achieve this opposite configuration. Nevertheless, the first maintenance modules 115A and 115B are identical to the second maintenance modules 115C and 115D and the print modules 200 all have a same orientation.

The relative arrangement of print modules 200 and maintenance modules 115 around the curved media feed path advantageously enables capping (and wiping) of printheads via linear translation of the print chassis 50 relative to the roller support chassis 10, as will now be explained with reference to FIGS. 4 and 5. In the schematic print engines shown in FIGS. 4 and 5, the convexly curved media feed path 3 is shown with an exaggerated curvature in order to amplify relative capping distances in the maintenance position and demonstrate the advantages of the present invention.

Figure 4:
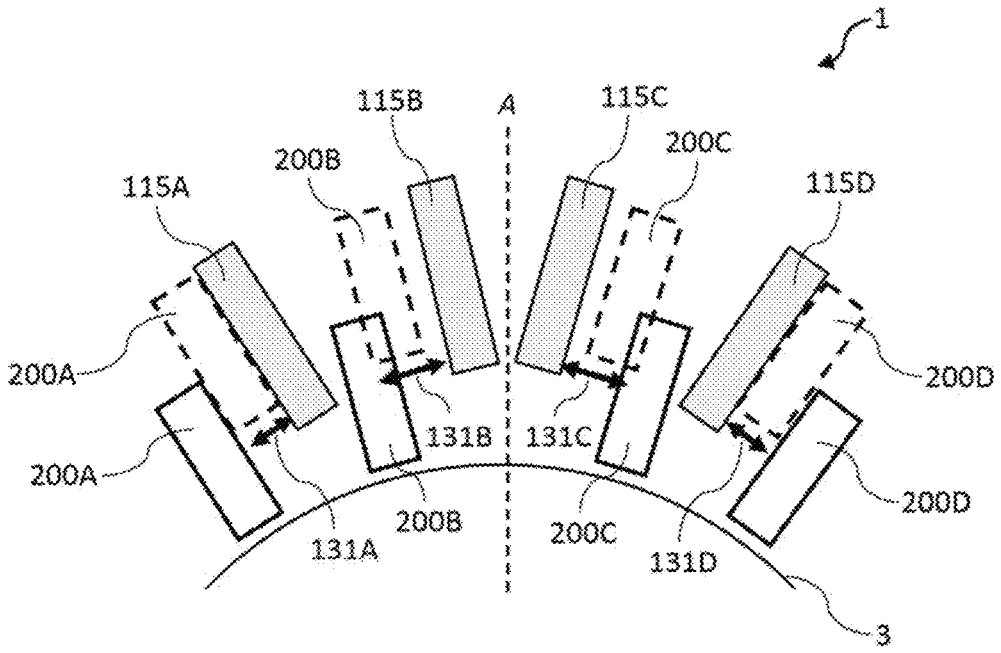
FIG. 4 is a schematic side view of the print engine shown in FIG. 1.

Turning initially to FIG. 4, the print engine 1 is shown schematically with four print modules 200A-D spaced apart around the curved media path 3. The print modules 200A-D are shown in solid outline in the printing position and in dashed outline in the raised maintenance position. Each maintenance module 115 is positioned at a predetermined distance from its respective print module 200 with a consistent separation between the two for each of the print/maintenance modules pairs. With the arrangement of maintenance modules 115 in the print engine 1 as described above (FIG. 4), it can be seen that each print module 200 moves towards its respective maintenance module when vertically translated into the maintenance position. The maintenance module 115A has an ideal capping distance 131A (that is, the lateral distance moved by the capper 130 when capping a printhead) when the print module 200A is in the maintenance position. The capping distance 131B for the maintenance module 115B increases somewhat closer to the apex A, but is still within an acceptable tolerance for capping its respective printhead. For the downstream maintenance modules 115C and 115D, the capping distances 131C and 131D are the same as the capping distances 131B and 131A, respectively, by virtue of the reversed arrangement of the maintenance modules 115C and 115D. Hence, simple linear translation of the print modules 200 may be used to position the print modules satisfactorily for capping (and wiping) without requiring more complex radial movement mechanism(s) for the print modules. Accordingly, the lift mechanism L and/or mounting arrangements for the print modules may be simplified in the print engine 1.

Figure 5:
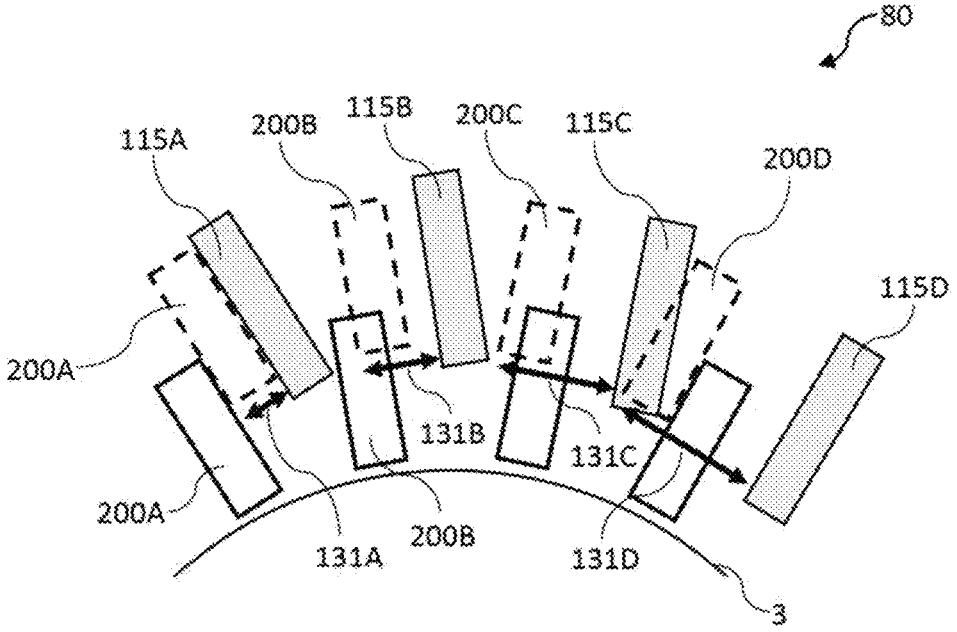
FIG. 5 is a schematic side view of a comparative print engine.

FIG. 5 shows schematically a comparative print engine 80 whereby maintenance modules 115 are positioned at a same side of each print module 200 in the array. It can be seen that the capping distances 131A-D continuously increase from the maintenance module 115A towards the maintenance module 115D. In particular, the capping distances 131C and 131D have increased to such an extent that capping of printheads mounted on print modules 200C and 200D is unfeasible.

Maintenance Module 115

The maintenance module 115 is generally as described in the Applicant's U.S. application Ser. No. 15/583,006 filed 1 May 2017, entitled "Printer having L-shaped maintenance modules for a plurality of printheads", the contents of which are incorporated herein by reference.

Each maintenance module 115 is fixedly mounted between opposite support chassis side plates 14 and defines a space or opening through which a respective print module 200 can extend and retract between the printing position (FIG. 1) and the maintenance position (FIG. 3), respectively. Accordingly, in the printing position, each printhead 216 is positioned at a suitable spacing from the media web.

Figure 6:
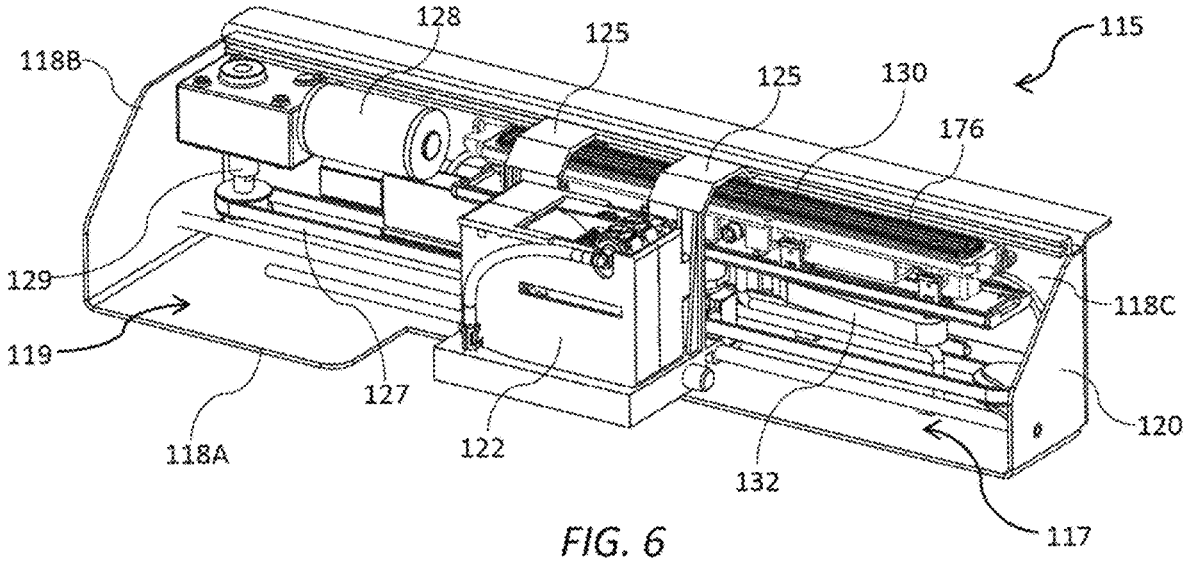
FIG. 6 is a perspective view of a maintenance module during a wiping operation.
Figure 7:
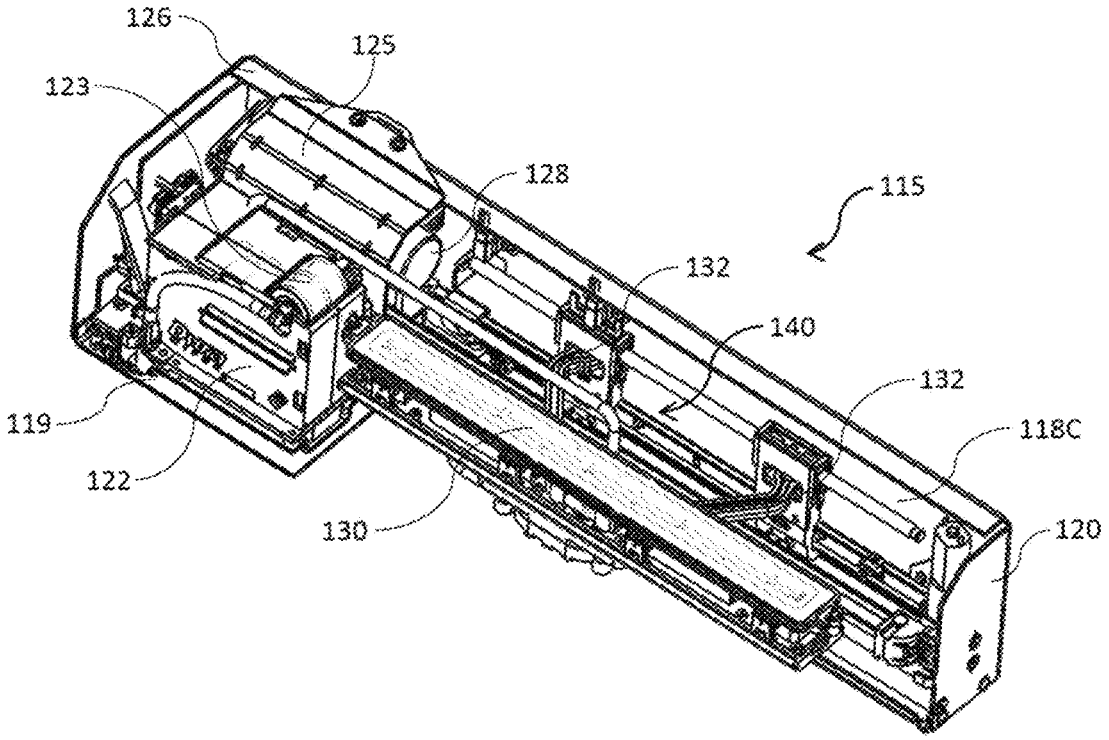
FIG. 7 is a perspective view of the maintenance module during a wiping operation.

Referring to FIGS. 6 and 7, the L-shaped frame 120 of the maintenance module 115 comprises a base plate 118A with a shorter side plate 118B and a longer side plate 118C extending upwards therefrom. The shorter leg 119 comprises the shorter side plate 118B and a corresponding part of the base plate 118A; the longer leg 117 comprises the longer side plate 118C and a corresponding part of the base plate 118A. The L-shaped frame 120 houses the wiper carriage 122 for wiping the printhead 216 and a capper 130 for capping the printhead.

As shown in FIG. 7, the wiper carriage 122 is in its home or parked position, whereby the wiper is positioned within the shorter leg 119 of the L-shaped frame 120. As shown in FIG. 6, the capper 130 is in its home or parked position, whereby the capper is positioned within the longer leg 117 of the L-shaped frame 120.

The wiper carriage 122 includes a length of wiping material 123, which moves longitudinally along a length of the print module 200 to wipe the printhead 216. The wiper carriage 122 is supported by one or more overhead arms 125, which are slidingly engaged in a carriage rail 126 fixed to the longer side plate 118C and extending along the longer leg 119 of the frame 120. In FIG. 6, the wiper carriage 122 has moved from its home position and is partway through a longitudinal wiping operation. The capper 130 is in its parked position and it can be seen that the overhead arms 125 bridge over the capper during the wiping movement of the wiper carriage 122. The wiper carriage 122 is traversed by means of an endless belt 127 driven by a bidirectional carriage motor 128 and belt drive mechanism 129. Printhead wipers of the type having a carriage carrying a web of wiping material are described in, for example, U.S. Pat. No. 4,928,120.

The capper 130 is mounted to the longer side plate 118C of the L-shaped frame 120 via a pair of hinged arms 132, which laterally extend and retract the capper into and away from a space occupied by the printhead 216 by means of a suitable retraction mechanism 140, such as those described in U.S. application Ser. No. 15/583,006. The capper 130 is shown in its capping position in FIG. 7 with both arms 132 extended, while the wiper carriage 122 is parked in its home position.

For capping operations, the print chassis 50 is lifted initially from a printing position (FIG. 1) into a transition position. With the print chassis in its highest transition position, the capper 130 is extended, and the print chassis then gently lowered to the maintenance position (FIG. 3) such that the printhead 216 is capped by the perimeter seal 176 of its respective capper. The reverse process configures the print engine 1 back into the printing position.

Similarly, for wiping operations, the print chassis 50 is lifted from the printing position and raised initially into a transition position. With the print chassis 50 in its highest transition position, the wiper carriage 122 is moved beneath the printhead 216 and the print chassis gently lowered into the maintenance position so that the wiping material 123 contacts a nozzle plate of the printhead. Typically, the wiping material 123 is resiliently mounted to allow a generous tolerance when the print chassis 50 is lowered. Once the wiping material 123 is engaged with the printhead 216, the wiper carriage 122 is traversed lengthwise along the printhead to wipe ink and/or debris from the nozzle plate of the printhead.

Print Module

Figure 8:
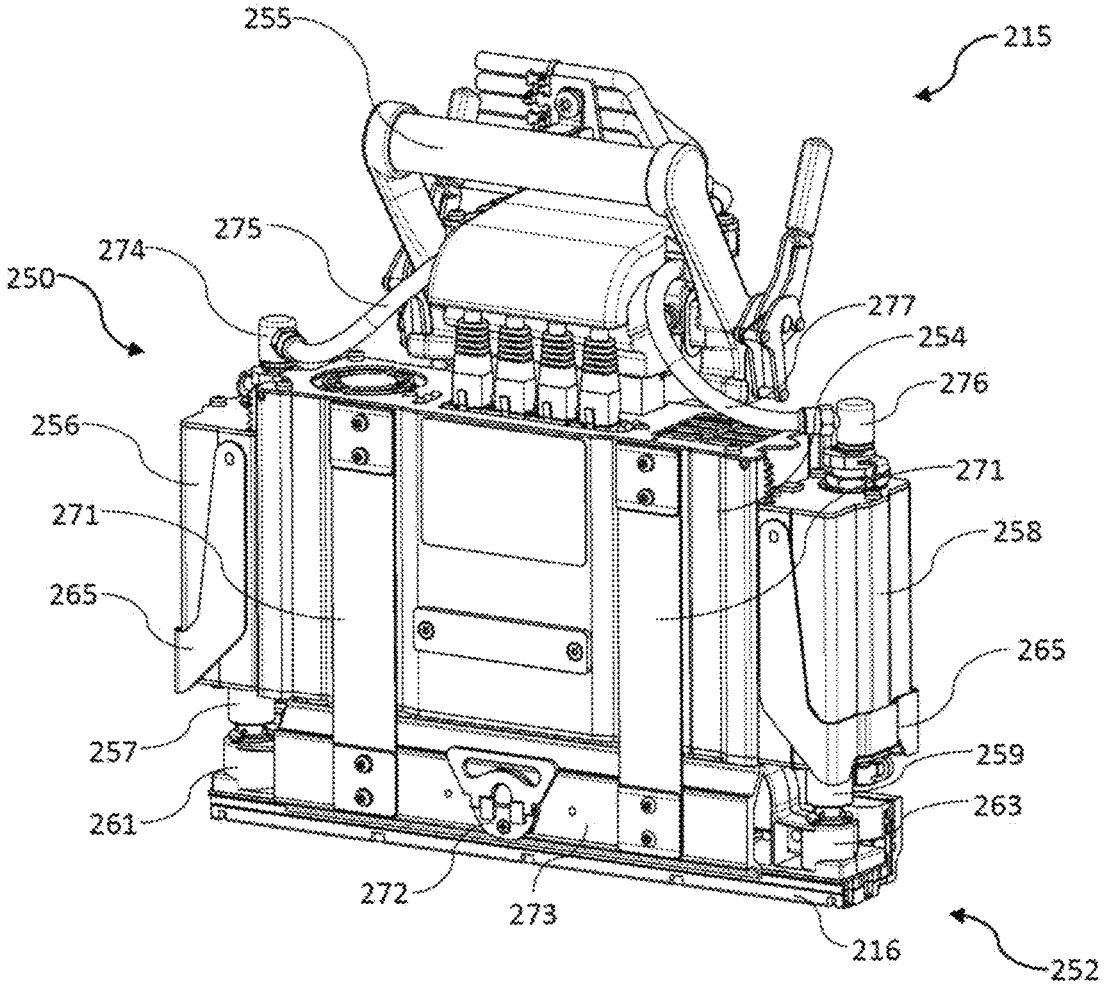
FIG. 8 is a perspective view of a print module.

The print module 215 will now be described in further detail with reference to FIGS. 8 to 10. The print module 215 comprises a supply module 250 engaged with a replaceable printhead cartridge 252, which includes the printhead 216. The printhead cartridge 252 may be of a type described in, for example, the Applicant's U.S. application Ser. No. 15/583,099 filed 1 May 2017, the contents of which are incorporated herein by reference.

The supply module 250 comprises a body 254 housing electronic circuitry for supplying power and data to the printhead 216. A handle 255 extends from an upper part of the body 254 to facilitate user removal and insertion into one of the sleeves 208 of the print bar chassis 200.

The body 254 is flanked by an ink inlet module 256 and an ink outlet module 258 positioned on opposite sidewalls of the body. Each of the ink inlet and ink outlet modules has a respective ink coupling 257 and 259 engaged with complementary inlet and outlet couplings 261 and 263 of the printhead cartridge 252. The printhead cartridge 252 is supplied with ink from an ink delivery system (not shown) via the ink inlet module 256 and circulates the ink back to the ink delivery system via the ink outlet module 258.

The ink inlet module 256 and ink outlet module 258 are each independently slidably movable relative to the body 254 towards and away from the printhead cartridge 252. Sliding movement of the ink inlet and outlet modules 256 and 258 enables fluidic coupling and decoupling of the printhead cartridge 252 from the supply module 250. Each of the ink inlet and outlet modules 256 and 258 has a respective actuator in the form of a lever 265, which actuates sliding movement of the modules. Each lever 265 rotates about an axis perpendicular to the printhead 216 and is operatively connected to a pair of pinions 281. Rotation of the pinions 281 causes lateral sliding of movement of the inlet and outlet modules 256 and 258 relative to the body 254 via engagement with complementary racks 283 extending upwards and fixedly mounted relative to the body. This lever arrangement minimizes the overall width of the print module 215. As shown in FIGS. 8 and 10, the ink inlet module 256 and ink outlet module 258 are both lowered and the printhead cartridge 252 is fluidically coupled to the supply module 250. As shown in FIG. 9, the ink inlet and outlet modules 256 and 258 are both raised and the printhead cartridge 252 is fluidically decoupled from the supply module 250.

Figure 9:
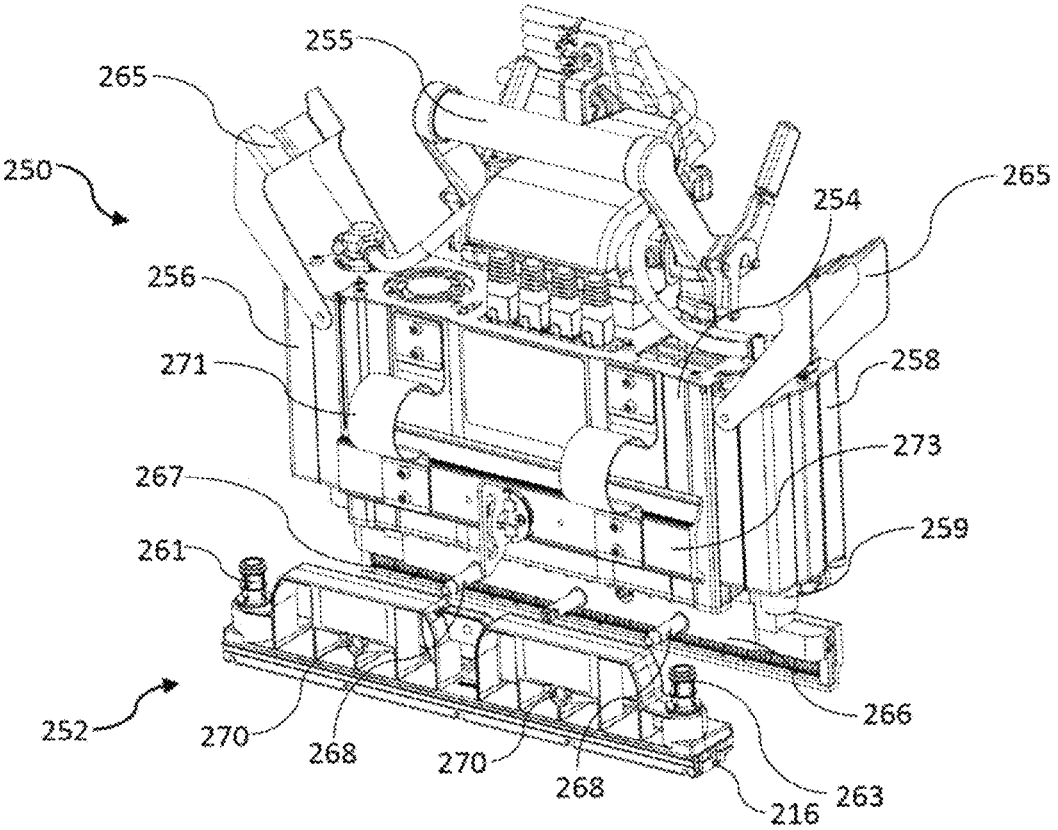
FIG. 9 is a perspective view of the print module with a printhead cartridge being decoupled.
Figure 10:
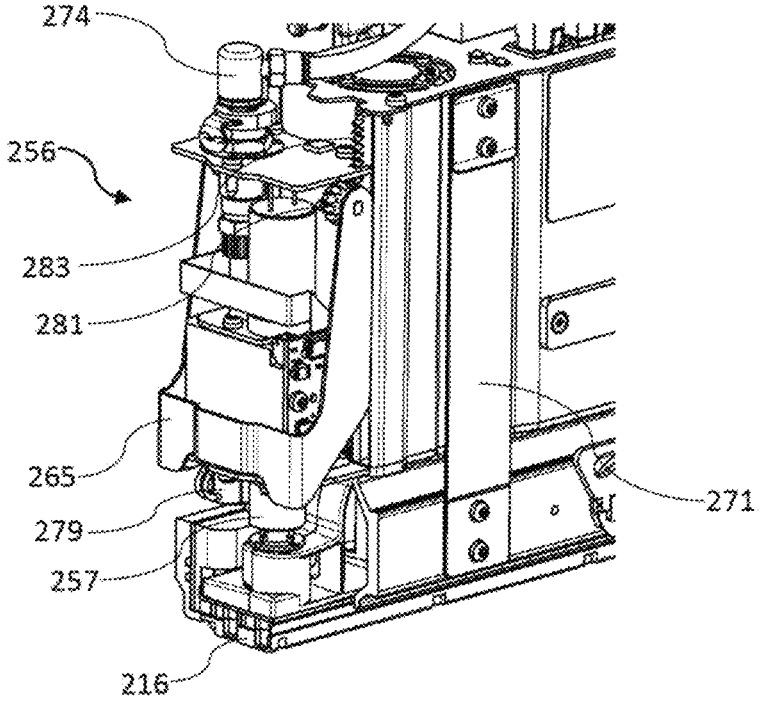
FIG. 10 shows an ink inlet module of the print module.

Still referring to FIG. 9, the supply module 250 has a clamp plate 266 extending from a lower part of the body 254. The lower part of the body 254 additionally has a row of electrical contacts 267 for supplying power and data to the printhead 216 via a complementary row of contacts (not shown) on the printhead cartridge 252 when the printhead cartridge is coupled to the supply module 250.

A set of locating pins 268 extend from the clamp plate 266 perpendicularly with respect to a sliding movement direction of the ink inlet and outlet modules 256 and 258. In order to install the printhead cartridge 252, each locating pin 268 is aligned with and received in a complementary opening 270 defined in the printhead cartridge 252. The printhead cartridge 252 is slid in the direction of the locating pins 268 towards the clamp plate 266. Once the printhead cartridge 252 is engaged with the clamp plate 266, a hinged clamp 273, connected to the body 254 via hinges 271, is swung downwards to clamp the printhead cartridge 252 against the clamp plate. The printhead cartridge 252 is locked in place by a fastener 272 on the hinged clamp 273. Finally, the ink inlet and outlet modules 256 and 258 are slid downwards via actuation of the levers 265 to fluidically couple the printhead cartridge 252 to the supply module 250. The reverse process is used to remove the printhead cartridge 252 from the supply module 252. The manual removal and insertion process, as described, can be readily and cleanly performed by users within a matter of minutes and with minimal loss of downtime in a digital press.

The ink supply module 256 is configured for receiving ink at a regulated pressure from an inlet line of an ink delivery system (not shown). A suitable ink delivery system for use in connection with the print modules 215 employed in the present invention is described in the Applicant's U.S. application Ser. No. 15/582,979, the contents of which are incorporated herein by reference. The ink inlet module 256 has an inlet port 274 for receiving ink from an ink reservoir (not shown) via an inlet line 275, while the ink outlet module 258 has an outlet port 276 for returning ink to the ink reservoir via an outlet line 277.

The ink inlet and outlet modules 256 and 258 independently house various components for providing local pressure regulation at the printhead 216, dampening ink pressure fluctuations, enabling printhead priming and de-priming operations, isolating the printhead for transport etc. In FIG. 10, the ink inlet module 256 is shown with a cover removed to reveal certain components of the ink inlet module. For example, there is shown a control PCB 278 having an ink pressure sensor and a microprocessor, which provides feedback to a control valve 279 for controlling a local pressure at the printhead 216. It will be appreciated that these and other components may be housed in the ink inlet and outlet modules 256 and 258.

From the foregoing it will be appreciated that the present invention advantageously provides a means by which an array of radially-arranged printheads may be capped in a raised position using a simple vertical (linear) lift mechanism as opposed to a more complex radial lifting arrangement for each printhead.

It will, of course, be appreciated that the present invention has been described by way of example only and that modifications of detail may be made within the scope of the invention, which is defined in the accompanying claims.

The invention claimed is:

1. A method of capping printheads positioned along a curved media path having an apex, said method comprising the steps of:

providing a first printhead upstream of the apex and a corresponding first capper downstream of the first printhead and upstream of the apex;

providing a second printhead downstream of the apex and a corresponding second capper upstream of the second printhead and downstream of the apex;

moving the first capper towards the first printhead and capping the first printhead; and moving the second capper towards the second printhead and capping the second printhead, wherein the first and second cappers are moved in opposite directions away from the apex for capping the first and second printheads.

2. The method of claim 1, wherein the first and second cappers are mounted on a maintenance chassis fixedly mounted relative to the curved media path.

3. The method of claim 1, wherein first and second maintenance modules respectively comprise the first and second cappers.

4. The method of claim 3, wherein a maintenance chassis comprises the first and second maintenance modules, the maintenance chassis being fixedly mounted relative to the media path.

5. The method of claim 3, wherein the first and second maintenance modules respectively comprise retraction mechanisms for extending and retracting the first and second cappers between the capped and uncapped positions, respectively.

6. The method of claim 3, wherein each maintenance module further comprises a wiper carriage for longitudinally wiping a respective printhead.

* * * * *